US005450954A

United States Patent [19]

Dunn

[11] Patent Number: 5,450,954

[45] Date of Patent: Sep. 19, 1995

[54] GOLF BAG WITH RETRACTABLE TOWEL ATTACHMENT

[75] Inventor: Steven B. Dunn, Santa Ana, Calif.

[73] Assignee: Bullet Golf Ball, Inc., Santa Ana, Calif.

[21] Appl. No.: 162,264

[22] Filed: Dec. 7, 1993

[51] Int. Cl.[6] ..... A63B 55/00; A63B 57/00

[52] U.S. Cl. ..... 206/315.5; 206/315.3; 273/32 R

[58] Field of Search ..... 206/315.3, 315.5, 315.6; 224/274; 150/154, 159, 160; 15/209.1; 273/32 R, 32 A, 32 B

[56] References Cited

U.S. PATENT DOCUMENTS

| | | | |
|---|---|---|---|
| 2,636,751 | 4/1953 | Carlson | 206/315.5 X |
| 2,803,845 | 8/1957 | Bradford | 15/209.1 |
| 3,015,351 | 1/1962 | Harris | 206/315.4 |
| 3,350,736 | 11/1967 | Frazelle et al. | 15/209.1 X |
| 3,938,570 | 2/1976 | Stewart | 150/160 |
| 4,498,579 | 2/1985 | Brick | 206/315.4 |
| 4,516,616 | 5/1985 | Fesler | 150/154 |
| 4,912,800 | 4/1990 | Zeltner | 273/32 B X |
| 4,932,523 | 6/1990 | Yamazoe | 206/315.2 X |
| 5,072,867 | 12/1991 | Zingale | 206/315.3 X |
| 5,230,117 | 7/1993 | Johnson et al. | 273/32 B X |

*Primary Examiner*—Sue A. Weaver
*Attorney, Agent, or Firm*—Edward A. Sokolski

[57] ABSTRACT

A golf bag has a retractable towel attachment mounted thereon. This attachment is formed by a spring loaded reel mechanism which is mounted in a compartment formed in a top inner portion of the bag, this reel portion having a line wound around it and normally held in a wound up state by the spring action of the reel. The line runs through an aperture in a side wall of the bag to an outer wall of the bag and has an attachment member on the free end thereof which is used to removably attach the line to a towel. The attachment member also operates to retain the end of the line against the side wall of the bag. The towel can be pulled away from the bag against the spring action of the reel for use in cleaning golf clubs, golf balls or other items and when released is retained along the side wall of the bag. The towel is readily removable from the attachment member for replacement when required.

5 Claims, 1 Drawing Sheet

GOLF BAG WITH RETRACTABLE TOWEL ATTACHMENT

BRIEF SUMMARY OF THE INVENTION

The device of the invention includes a spring loaded reel around which a line is wound and retained in the wound up condition by the spring action. This reel is mounted in a compartment formed within the bag along an upper inner side wall thereof. The free end of the line is fitted through an aperture formed in the side wall of the bag side and is connected to an attachment member which is used to attach the line to a towel. The towel is retained to the attachment member both when in use and when being stowed but can be readily removed therefrom for replacement. The attachment member is large enough to that it will not fit through the aperture in the bag. The towel thus can be drawn away from the bag against the spring action of the reel for use in cleaning and drying and when released by the user will be drawn back into its stowed position along the side of the bag by the reel's spring action.

It is therefore an object of this invention to facilitate the use of a towel by a golfer for cleaning clubs, balls and other objects.

It is a further object of this invention to provide a towel on a golf bag which is retained to the bag by spring action when not in use and can be drawn away from such bag against such spring action for utilization.

Other objects of this invention will become apparent from the following description taken in conjunction with the accompanying drawings.

DETAILED DESCRIPTION OF THE INVENTION

Figure 1:
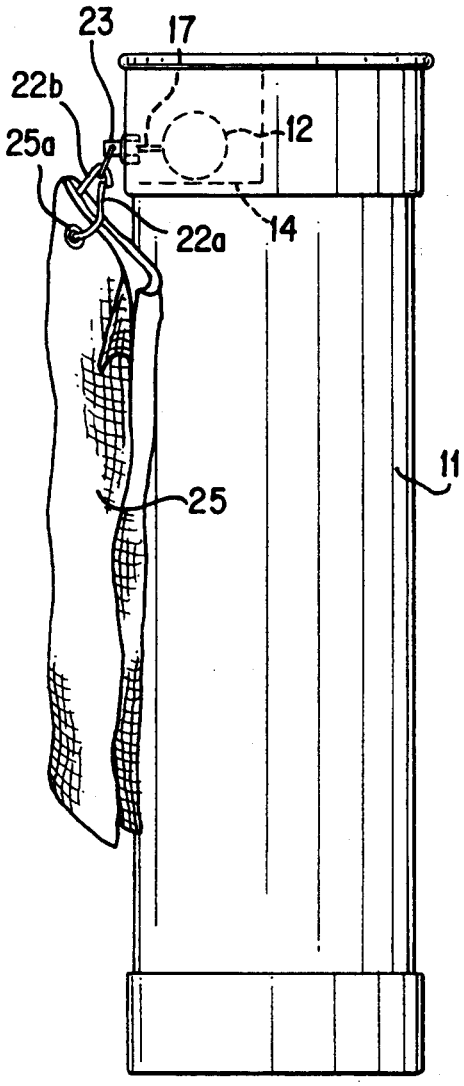
FIG. 1 Is a side elevational view of a preferred embodiment of the invention.
Figure 2:
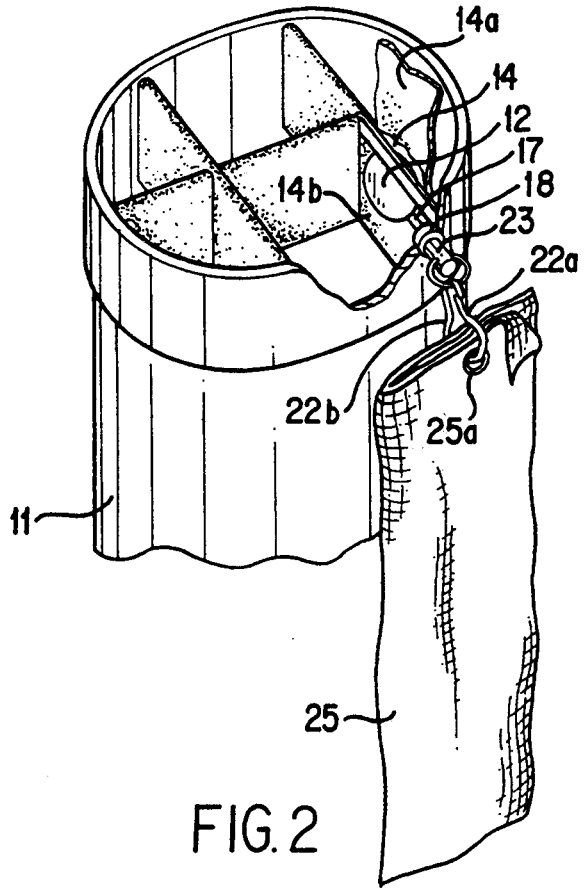
FIG. 2 is a top perspective view of the preferred embodiment.
Figure 3:
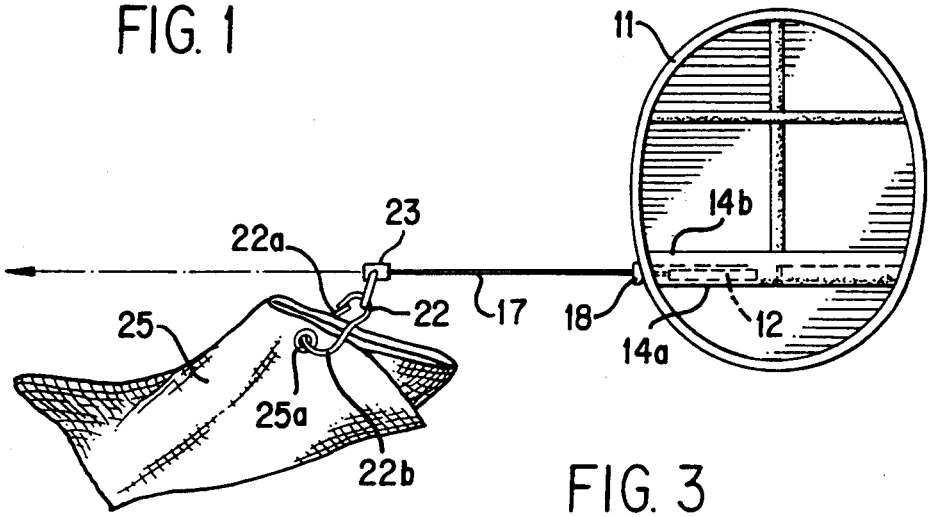
FIG. 3 is a top plan view of the preferred embodiment of the invention showing the towel being drawn away from the bag.

Referring to FIGS. 1–3, a preferred embodiment of the invention is illustrated. Golf bag 11 has a spring loaded reel 12 mounted within a compartment 14 formed in the top inner portion of the bag. A flap 14*a* is used to retain the reel in the compartment, this flap and the side wall 14*b* of the compartment having mating hook-loop fasteners thereon, thus facilitating ready replacement of the reel if required. Flap 14*a* is shown in its raised unfastened position in FIG. 2. A line 17 is wound around the reel in spring loaded fashion. Line 17 may be of nylon or other suitable durable flexible material while the reel may be a commercially available reel.

Line 17 is fitted through eyelet 18 installed in an aperture formed in the side wall of the bag. Attached to the free end of line 17 is a bushing 23 attached to ring member 20 which is in turn attached to an attachment member 22. The ring member is large enough so that it will not fit through eyelet 18. Attachment member 22 is a conventional ring connector of the type commonly used for hanging shower curtains or as a key ring. Attachment member 22 has a spring finger 22*a* which when pressed towards the opposite arm 22*b* of the attachment member can be fitted into a groove formed in such arm to form a closed ring. Attachment member 22 is used to attach towel 25 to ring member 20 by fitting the attachment member both through eyelet 25*a* installed in the towel and the ring member and then snapping it into its closed ring position.

When in use, the towel can be drawn away from the bag against the spring action of reel 12, as shown in FIG. 3. After use, the towel can be released whereupon it will be drawn back into the position shown in FIG. 1 by the spring action of the reel whereat it is retained in position. The towel can readily be removed for laundering or replacement by merely opening attachment member 22. Reel 12 can also readily be removed for replacement if the line breaks or its operation otherwise becomes unsatisfactory.

While the invention has been described and illustrated in detail, it is to be clearly understood that this is intended by way of illustration and example only and is not to be taken by way of limitation, the scope of the invention being limited only by the terms of the following claims.

I claim:

1. A golf bag comprising:

a compartment formed in said bag;

a spring loaded reel mounted in said compartment;

a line wound around said reel and retained in a wound up state on said reel by the spring action of said reel;

an aperture formed in an outer wall portion of said bag, said wall portion forming part of the compartment and said aperture providing an opening into said compartment;

said line running through said aperture to the outside of said bag;

an attachment member connected to one end of said line;

ring means attached to said attachment member for preventing said attachment member from passing through said aperture;

said attachment member and said ring means being resiliently held against the outer wall portion of said bag by the spring action of said reel;

a towel; and means for removably attaching said towel to said ring means in retention thereon;

said towel being withdrawable away from the bag against the spring action of said reel for use in cleaning items and upon release being drawn back against said bag by said spring action.

2. The bag of claim 1 wherein said aperture includes an eyelet installed in said bag outer wall portion.

3. The bag of claim 1 wherein said removable attachment means comprises a spring connector which has a spring finger and an opposing arm with a groove formed therein, said spring finger being releasably fitted in said groove to form a closed ring.

4. The bag of claim 3 wherein said towel has an eyelet installed thereon, said removable attachment means being removably fitted through said eyelet.

5. The bag of claim 1 wherein said compartment has a flap forming a wall of said compartment, said flap and an opposite wall of said compartment having mating hook-loop fasteners formed therein, thereby enabling removable retention of said flap to said opposite wall, to retain said reel in said compartment.

* * * * *